United States Patent [19]

Randolph

[11] 4,176,464

[45] Dec. 4, 1979

[54] METHOD AND APPARATUS FOR THE CONTROLLED DRYING OF LUMBER AND THE LIKE

[76] Inventor: George J. J. Randolph, 803 SE. Kane St., Roseburg, Oreg. 97470

[21] Appl. No.: 872,452

[22] Filed: Jan. 26, 1978

[51] Int. Cl.[2] ..... F26B 5/00; F26B 21/00

[52] U.S. Cl. ..... 34/16.5; 34/13.8; 34/54; 34/191

[58] Field of Search ..... 34/13.8, 54, 191, 16.5; 73/73, 74

[56] References Cited

U.S. PATENT DOCUMENTS

| | | | |
|---|---|---|---|
| 1,086,567 | 2/1914 | Stone | 34/54 |
| 3,131,034 | 4/1964 | Marsh | 34/54 X |
| 3,233,334 | 2/1966 | Hamilton | 34/54 X |
| 3,522,663 | 8/1970 | Grimmelt et al. | 34/54 |

*Primary Examiner*—John J. Camby

*Attorney, Agent, or Firm*—Kolisch, Hartwell, Dickinson & Stuart

[57] ABSTRACT

A method and apparatus for controlling the drying of lumber and the like. During drying, the weight of a lumber charge is continuously monitored to indicate both total weight loss and rate of weight loss. These data are employed, either automatically or manually, to adjust drying action so as to control the moisture-removal rate, and to stop drying action when the desired terminal dryness is reached. Multi-point weight monitoring is used to provide localized moisture-content data. The latter data is used further to adjust drying action so as to promote uniform moisture levels throughout a charge during drying.

5 Claims, 2 Drawing Figures

METHOD AND APPARATUS FOR THE CONTROLLED DRYING OF LUMBER AND THE LIKE

BACKGROUND AND SUMMARY OF THE INVENTION

This invention pertains to a method and apparatus for controlling the drying of a product, such as lumber, in apparatus such as a dry kiln. More particularly, the invention proposes what might be thought of as a "hands off" method and apparatus for the continuous following of the moisture level and of the moisture removal rate respecting such products. A preferred embodiment of, and method of practicing, the invention are described herein in conjunction with the kiln-drying of lumber, in which situation the invention has been found to have particular utility.

As is well known to those skilled in the wood products industry, kiln-drying of lumber is an important operation. Typically, lumber which is to be dried is stacked on a cart which is wheeled into a kiln, wherein it is subjected to heat and continuous gas flow. "Wet bulb" and "dry bulb" temperatures are monitored within the kiln during drying—the difference therebetween being known as "depression". The amount of depression affects the rate of drying, and depression is manually controlled, when thought necessary, through the introduction of additional moisture into the kiln atmosphere, and/or through changes in the venting of the kiln.

At the beginning of a drying operation, a kiln operator, using a conventional moisture meter, manually checks the moisture content of the undried lumber at various selected points distributed throughout the charges of lumber in the kiln. Depending upon the species of lumber involved, the operator consults existing charts, that have been developed over the years, which indicate the rate at which moisture should be removed, and the end-point dryness which is desired. These charts also provide some rough indications of the times and temperatures involved in achieving this end-point at a proper drying rate. The kiln is then activated, and drying begins.

By watching wet bulb and dry bulb temperature data, the operator estimates moisture-removal rate, and manually makes any adjustments which he feels are necessary. However, the only way in which he can actually know how much moisture has been removed at any given time is to shut down the kiln, enter it, and take another series of distributed-point moisture readings. This, in fact, is the technique most widely used heretofore. Often, this kind of checking (which takes a considerable amount of time, and requires stopping the drying operation), is done well in advance of when the lumber has reached its end-point dryness. As a consequence, the kiln must be reactivated for another estimated time period.

Hopefully, a skilled operator will estimate fairly accurately when the lumber has reached proper dryness. However, it is usually the case that the dried lumber ends up somewhat more moist than what is optimally desired. Rather than take the chance of over-drying, the operator will usually early declare the lumber finished or ready. However, there are occasions, occurring often enough to be troublesome, where lumber becomes over-dried. When this happens the lumber must be downgraded, and this, of course, creates an economic loss.

A general object of the present invention is to provide a unique method and apparatus for continuously monitoring and controlling, or enabling controlling of, the drying of a product, such as a charge of lumber, in a manner offering a number of significant improvements and advantages over prior art techniques.

More specifically, an object of the invention is to provide such a method and apparatus which proposes a "hands off" technique for such monitoring and control.

A further object of the invention is to provide a method and apparatus as generally outlined which deals both with monitoring and controlling both the absolute moisture content of a charge, and the rate of removal of moisture from the charge.

According to the invention, during drying, the weight of a charge, such as a charge of lumber, is continuously monitored to indicate both total weight loss and rate of weight loss. These data are employed to enable automatic, or if desired, manual, adjustment of drying action so as to control the moisture removal rate, as well as to stop the drying action when the desired terminal dryness is reached. Such data are also used to produce a continuous chart recording of exactly what is occurring with respect to moisture removal from the charge. A special feature of the invention is that multipoint weight monitoring is used to provide localized moisture-content data respecting a charge. The data derived from this feature is used further to adjust drying action so as to promote uniform moisture levels throughout a charge during drying. In other words, it tends significantly to promote a uniformly dried product.

Yet another important object of the invention is to provide apparatus which may easily and quickly be installed in existing dry kilns, with little appreciable disruption of dry kiln operation.

Still a further object of the invention is to provide a method and apparatus as outlined which is simple, economical, accurate and extremely reliable.

These and other objects and advantages which are attained by the invention will become more fully apparent as the description thereof which now follows is read in conjunction with the accompanying drawings.

DETAILED DESCRIPTION OF THE INVENTION

Figure 1:
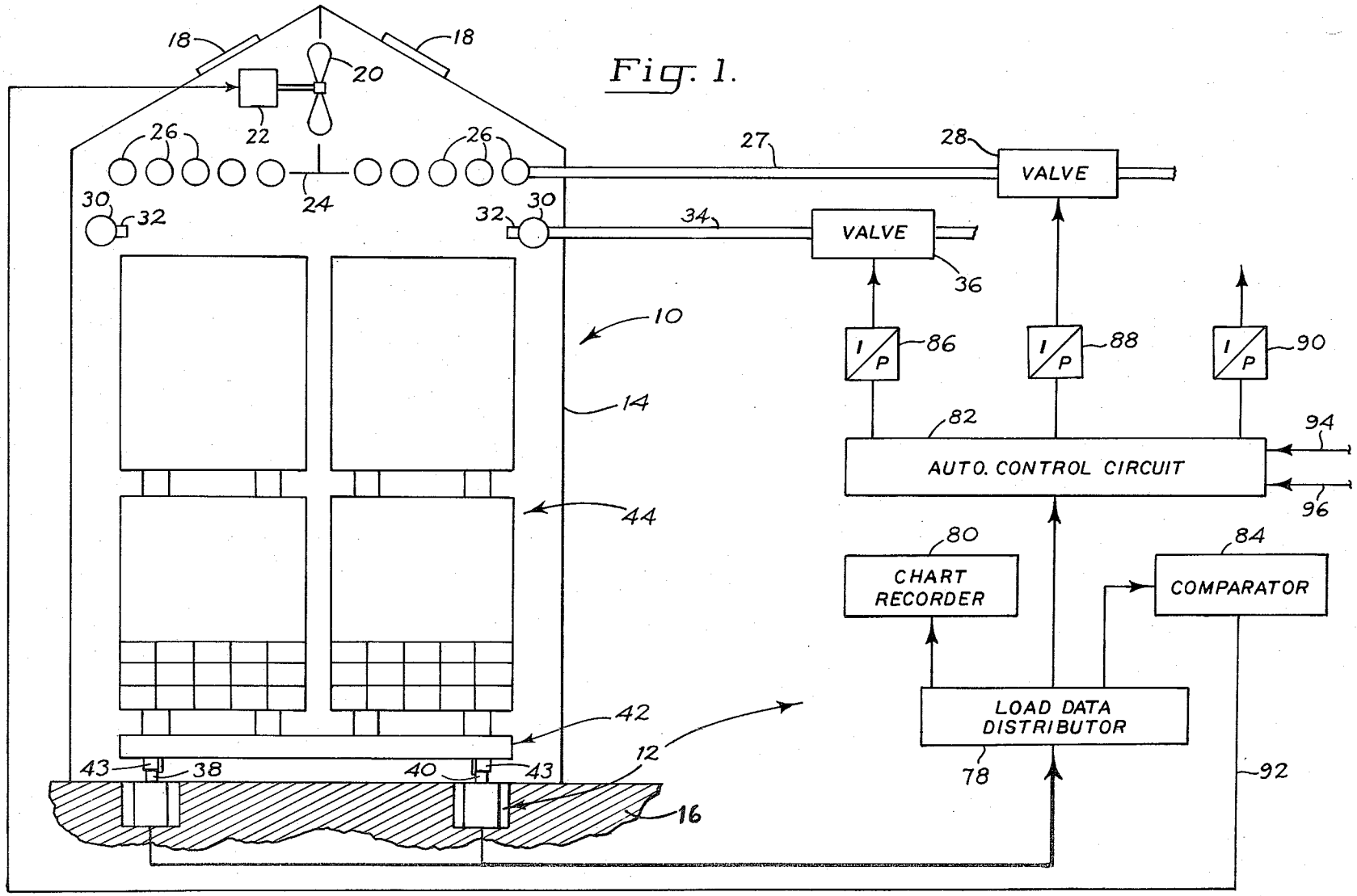
FIG. 1 is a simplified block and schematic diagram showing an end view of a kiln equipped with apparatus constructed in accordance with the present invention, with such apparatus connected for use with selective manual/automatic drying control equipment employed with the kiln.

Turning now to the drawings, indicated generally at 10 in FIG. 1, and shown in simplified end view therein, is a lumber dry kiln which is equipped, and used in conjunction, with apparatus 12 constructed in accordance with the present invention. Kiln 10 includes the usual elongated shed or housing 14, which has a length of about 110-feet—this housing being mounted on a conventional footing or foundation. The roof of the housing, along the length thereof, is provided with a plurality of adjustable vents, such as the two shown at 18, which may automatically be actuated to open or close to different selected degrees as desired. These vents are entirely conventional in construction.

Distributed at spaced intervals along the top of the inside of housing 14 are plural fans, such as fan 20, which are driven by reversible electric motors, such as the motor shown at 22 for fan 20. These fans and motors are referred to herein as changeable-direction gas-flow-producing means. The space below these fans and motors, extending to foundation 16, is referred to herein as a drying zone. From the point of view of one looking along the longitudinal axis of the kiln—the point of view of FIG. 1—operation of a fan in one direction produces a generally clockwise circulating current of gas within the kiln, in the plane of the fan, and operation of the fan in the opposite direction produces a generally counterclockwise similar current of gas. An elongated baffle 24 extends substantially the length of the kiln centrally beneath the fans.

Gas-flow direction in kiln 10 is determined by the axial orientations of the fans, as well as by the running directions of the motors. In other kilns, gas-flow direction may be determined by complex baffling, and/or by adjustment of the blades in variable-pitch fan blades. As can be appreciated with reference to FIG. 1, such clockwise and counterclockwise currents of air produce a substantially lateral right-to-left and left-to-right flow of air, respectively, within the drying zone.

Disposed on opposite sides of baffle 24 are elongated longitudinally extending heating pipes, such as pipes 26, which are supplied through a pipe 27 with steam from a suitable source thereof outside the kiln. Supply of steam to pipes 26 through pipe 27 is effected through an air-pressure-operated control valve shown in block form at 28. Positioned below pipes 26 in housing 14, and extending longitudinally thereof along opposite upper sides of the housing, are two interconnected water-spray pipes 30, each of which has a plurality of orifices, such as orifices 32, distributed along the length thereof. These pipes are commonly fed from a suitable source of water external to the kiln through a feeder pipe 34 which connects to such source through an air-pressure-operated control valve 36.

Vents 18, fans 20, motors 22, heating pipes 26, and water-spray pipes 30 all form part of what is referred to herein as regulatable drying control means in kiln 10. These various components are shown only in extremely simplified schematic form, inasmuch as their respective constructions are conventionally known, and form no part of the present invention.

Each charge of lumber which is to be dried in kiln 10, is stacked in a suitable manner on a conventional flanged-wheeled cart which is moved into and out of the drying chamber on elongated parallel rail lines, such as the two rail lines shown at 38, 40. Rail lines 38, 40 extend the length of the kiln, and it is typical that a plurality of carts carrying lumber charges are placed in the kiln for each drying operation. Referring to FIG. 1, a conventional cart of the type just generally mentioned is shown at 42, having flanged laterally spaced wheels, such as wheels 43, and carrying a charge of stacked lumber 44. Cart 42 herein is of conventional construction and size, having a width of about 5-feet and a length of about 8-feet. As measured longitudinally, the axle-to-axle wheel spacing is about 7-feet. Rail lines 38, 40 are also referred to herein as rail means in the kiln defining a path for the movement of carts such as cart 42.

According to an important feature of the invention, means is provided in kiln 10 for continuously monitoring the weight, and any changes therein, of a charge of lumber in the drying chamber. More particularly, such a charge-weighing means is proposed to accommodate multi-point weight, and weight-change, monitoring of a charge.

Figure 2:
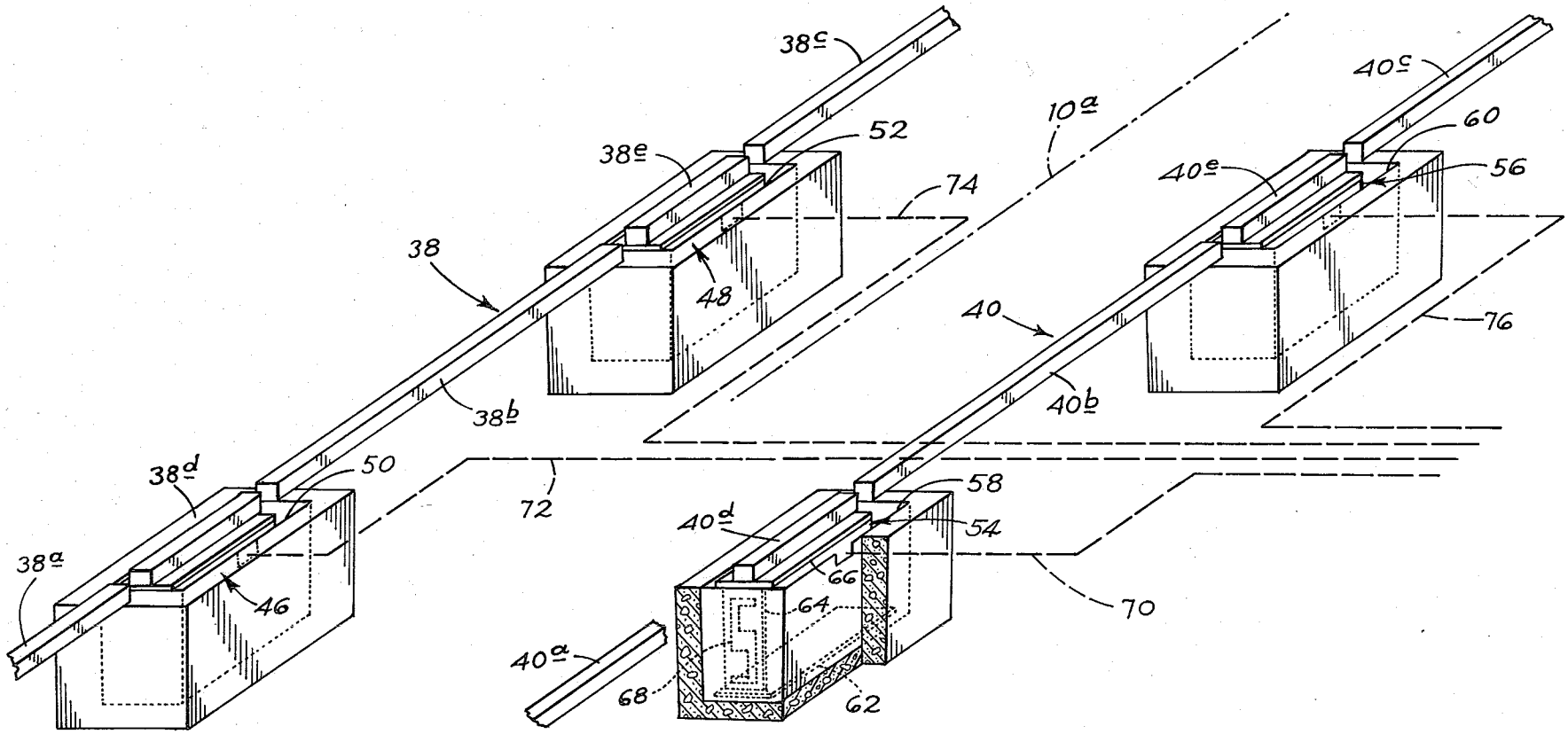
FIG. 2 is an enlarged fragmentary view of a portion of the kiln of FIG. 1, showing load sensors that are used as contemplated herein with respect to cart rails that are provided in the kiln.

Referring to FIG. 2 along with FIG. 1, in accordance with the invention each of rail lines 38, 40 takes the form of a plurality of axially aligned disjoined rail sections including what might be thought of as ground-anchored rail sections alternating with somewhat shorter vertically movable, floating rail sections—the latter being carried on the charge-weighing means of the invention. For example, and considering the portion of rail line 38 which is shown in FIG. 2, ground-anchored rail sections **38*a*, 38*b*, 38*c* alternate with relatively short (about 1-foot long herein) floating rail sections 38*d*, 38*e*. Sections, such as sections 38*a*, 38*b*, 38*c*, are suitably secured directly to the ground. Sections 38*d*, 38*e* are mounted as will be described on charge-weighing means 46, 48, respectively, which are disposed within metal-lined, concrete supported wells 50, 52, respectively, formed in the ground. Referring to rail line 40 as shown in FIG. 2, the same includes ground-anchored rail sections, such as those shown at 40*a*, 40*b*, 40*c*, alternating with floating rail sections such as those shown at 40*d*, 40*e*. Floating sections 40*d*, 40*e* are mounted on charge-weighing means 54, 56, respectively, which are disposed within wells 58, 60**, respectively.

The several floating rail sections just mentioned are substantially the same in construction. The opposite ends of rail sections **38*d*, 40*d* are aligned along lines which extend substantially normal to the longitudinal axis 10*a* of the kiln. The same situation is true with respect to alignment of the ends of rail sections 38*e*, 40*e*. These four rail sections are grouped relative to one another to form what will be referred to hereinafter as a cart-weighing grouping. More specifically, they are positioned relative to one another whereby a cart, such as cart 42, may be stopped on the rail lines with its four supporting wheel assemblies fully resting on and completely supported by the four floating rail sections. It is contemplated by the invention that other such cart-weighing groupings are provided at appropriate intervals along the rail lines in kiln 10** to accommodate a plurality of end-to-end disposed carts in a train.

Still with reference particularly to FIG. 2, the constructions of the four charge-weighing means therein, all of which are substantially the same, will now be described with reference to charge-weighing means, or unit, 54. In general terms, unit 54 includes an elongated rectangular metallic base plate 62, to opposite ends of which are joined, as by welding, upright metallic rectangular end plates, such as plate 64. Bracing these end plates are two parallel upright metallic side plates (not shown). Joined to the tops of the end plates is a substantially horizontal, elongated, rectangular metallic top plate 66, which also is referred to herein as a weight-transmitting means. This top plate is entirely supported on the two end plates. Floating rail section **40*d* is joined as by welding to top plate 66, and unit 54 is suitably securely seated in well 58 so as to position rail section 40*d* in axial alignment with rail sections 40*a*, 40*b*. The gaps between rail sections 40*d* and 40*a*, 40*b*** are about 0.5-inches.

Joined to each of the end plates is a generally s-shaped extensometer device of the type described in U.S. Pat. No. 3,878,711. Such a device is shown generally at 68 in FIG. 2. Device 68 has its opposite (upper and lower) ends secured to the upper and lower ends of plate 64, and the particular extensometer device used herein is equipped with piezoresistive devices whose resistance values change in direct proportion to the amount of vertical load transmitted through plate 64.

The piezoresistive devices in extensometer 68 are connected electrically in parallel with those in the other extensometer used in unit 54, and connections are made thereto which extend away from unit 54 through a conduit-protected cable indicated generally at 70 in FIG. 2. The specific way in which such connections are made are well known to those skilled in the art and form no part of the present invention.

Cables 72, 74, 76, which correspond to cable 70, extend from the electrically connected extensometers in units 46, 48, 56, respectively.

Completing a description of the invention, and referring once again especially to FIG. 1, the conductors in cables 70, 72, 74, 76 are fed to suitable signal-processing and distributing circuitry represented by block 78 in FIG. 1, and designated "Load Data Distributor". The just-mentioned "Distributor" and units 46, 48, and 54, 56 connected thereto, are also referred to herebelow as weight-sensing means for sensing the lateral distribution of weight carried by the laterally spaced rail sections. This circuitry is completely conventional in construction, can take any one of a number of well known forms, and hence, is not described herein in any detail. Output signals are provided from the distributor circuitry to a conventional chart recorder 80, to an automatic control circuit 82, and to a conventional comparator circuit 84.

Chart recorder 80, also referred to herein as data-presenting means, operates, as will be more fully explained, throughout a drying cycle in kiln 10, to show and record the exact instantaneous total weight of the charge of lumber on a cart such as cart 42. The presentation made by the recorder is instantly and continuously readable.

Control circuit 82, which also is, internally, entirely conventional in construction, utilizes total cart-weight data provided by circuitry 78 to supply electrical control signals to three conventional electrical-to-air-pressure transducers 86, 88, 90, represented in FIG. 1 by blocks diagonally divided, and bearing the letters "I" and "P". The pressure-control output of block 86 connects with previously mentioned valve 36, that of block 88 connects with previously mentioned valve 28, and that of block 90 connects with conventional pressure-control apparatus (not shown) provided for vents 18. The specific operation of control circuit 82 will be explained shortly.

With respect to the cart-weighing rail grouping illustrated in FIG. 2, comparator 84 is supplied with data whereby it can compare the total weight monitored collectively by units 46, 48, with that monitored collectively by units 54, 56. From this comparison, the comparator circuit "determines" whether at any given time one side of a charge on a cart is heavier or lighter than the other side of the charge. Comparator 84 supplies, as will shortly be described, a control output signal through a conductor 92 to the reverse-direction control input provided for fan motor 22.

Explaining now how the apparatus of the invention as described herein performs, and with reference to loaded cart 42 being placed so as to position its wheels on rail sections **38*d*, 38*e*, 40*d*, 40*e*, signals are produced by the weight-sensing units which are directly indicative of the specific weights transmitted to them through their respective associated rail sections. In other words, data is continuously available respecting what might be thought of as the weights of the four corners of the combined cart and charge of lumber. These signals are fed, on a continuous basis, to distributor circuitry 78, wherein appropriate "initialization" steps are provided for. More specifically, in order to be able to follow precisely the weight of charge 44, it is necessary to know the weight of cart 42**, which weight is then electrically "subtracted" so as to leave only an indication of charge weight.

Kiln 10 is closed and "fired up" in the usual manner to begin a drying operation. From data respecting the species of lumber being dried in the charge, from the charge's size, and from its initial weight, the initial moisture content in the charge is easily determined, and used to establish initial drying conditions in the kiln. More specifically, this information is used as the basis for setting an initial kiln temperature and venting condition. The fans are operated each in a given similar direction to produce what may be visualized as a cylindrical circulating flow of gas in the kiln. Conventional wet bulb and dry bulb kiln temperature data is fed via a pair of conductors 94, 96, respectively, to control circuit 82. Chart recorder 80 operates continuously to record the total weight of charge 44.

In a substantially totally automated operation, which is possible according to the invention, control circuit 82 is suitably furnished with data respecting the rate at which moisture, at any given time, should be removed from the lumber in charge 44. This data may be provided the control circuit in any number of well known ways. Since the rate of moisture removal is directly proportional to the rate of weight loss of the charge, this data is used in the control circuit in conjunction with that fed to it from distributor circuitry 78, to effect appropriate controls on valves 28, 36, and on the apparatus controlling vents 18. In other words, simply by following, over time, the changes (losses) that occur in charge weight, control circuit 82 can make appropriate adjustments in kiln temperature, kiln humidity, and kiln venting to maintain the actual rate of moisture removal substantially duplicative of the desired rate of moisture removal. Further, by simply supplying control circuit 82 with data respecting desired terminal dryness, as indicated by terminal charge weight, the kiln can automatically be shut down at the appropriate time.

Comparator 84 follows any tendency of one side of the charge to retain more moisture than the other, as indicated by side-to-side weight differences. When it notes a certain such weight difference, it supplies a signal which then reverses the operations of the fans so as to correct this situation. Comparator 84 is also referred to herein as means operatively connecting the weight-sensing means to the fans to adjust the direction of gas-flow according to the weight distribution sensed by the sensing means.

It is thus obvious that through use of the present invention an accurate drying cycle for a charge of lumber can be performed in a "hands off" manner, i.e., without requiring shutting down of the kiln for the purpose of entering and taking moisture readings. Further, it is evident that the rate at which moisture is removed from a charge is directly, instantaneously and accurately monitorable, and further, directly usable to adjust drying action so as to follow a desired moisture removal rate.

Chart recorder 80 is directly and instantly readable by a kiln operator to determine exactly what is occurring with respect to charge drying. He is thus provided with continuous confirmation as to what is occurring in the kiln. If he wishes to take over manual control of drying operation, or in a situation in which automatic control is not provided for, he can, from the information provided him by the chart recorder, and through using the usual conventional manual controls provided for the kiln, himself make all the necessary periodic adjustments. Again, it is not necessary to shut down the kiln and take inside moisture readings.

Data from other cart-weighing groupings within the kiln are used in a manner similar to that derived from the grouping whose operation has just been described.

Another very important advantage afforded by the apparatus of the invention is that it can easily be installed in existing kilns with little disruption in kiln operation. In particular, it is a relatively simple matter to remove sections of the usual rails in a kiln, to excavate so as to provide wells, like well 50, and to install weight sensors and floating rails like those shown in FIG. 2. In most instances, such a conversion can be made at relatively low cost, and within a period of usually less than a week.

While the apparatus of the invention, and more particularly, one embodiment thereof, has been described herein in conjunction with the drying of wood, and with equipment such as a kiln, it will be obvious to those skilled in the art that the invention is readily usable in connection with the drying of other products, and in conjunction with other kinds of drying equipment. Thus, while a preferred embodiment of, and method of practicing, the invention having been described herein, it is appreciated that variations and modifications may be made without departing from the spirit of the invention.

It is claimed and desired to secure by Letters Patent:

1. In a dry kiln and the like including a defined drying zone and control means regulatable to control drying therein, apparatus for guiding the removal of moisture from a charge within said zone, said apparatus comprising a plurality of spaced-apart weight sensors operable to follow changes in the weights of different portions of a charge placed in said zone, and means operatively interconnecting said sensors and said regulatable control means for regulating the latter in accordance with the respective weights sensed by the former, said control means including changeable-direction gas-flow-producing means, and said interconnecting means, including means responsive to differences in the particular weights sensed by said sensors to adjust the direction of gas-flow created by said gas-flow-producing means.

2. In a drying apparatus including a dry kiln having a defined drying zone, gas-flow-producing means for producing gas flow within said zone selectively in either of two substantially opposed lateral directions, and a cart adapted to be received within said zone, said cart having plural pairs of laterally spaced wheels and carrying a charge which is to be dried within said zone, rail means forming a longitudinally extending path into and out of said zone, said rail means including plural pairs of laterally spaced, independently vertically movable, disjoined rail sections disposed in sets, each to be engaged by the laterally spaced wheels in a cart within said zone, weight-sensing means for each set, each operatively connected to the rail sections in the set for sensing the lateral distribution of weight carried by said sections, and means operatively connecting said weight-sensing means and said gas-flow-producing means to adjust the direction of gas-flow created by the latter according to the weight distribution sensed by the former, thus substantially to equalize the rate of drying at opposed lateral sides of such charge.

3. The apparatus of claim 2, wherein said weight-sensing means includes a weight sensor, each operatively to one of said rail sections for sensing the weight carried thereby.

4. A method of controlling the drying of a charge of lumber or the like, comprising placing said charge in a selected drying zone, wherein the charge has a lateral weight distribution which varies according to the extent of drying of opposed lateral sides of the charge, directing a gas flow over said charge selectively in one of two substantially opposed lateral directions, by said directing, drying the charge at rates which vary between such opposed sides while so drying, monitoring, over time, the lateral weight distribution of said charge, and as a result of said monitoring, selectively changing the direction of gas flow to produce substantially uniform lateral drying of said charge.

5. In a drying apparatus including a dry kiln having a defined, longitudinally extending drying zone, a plurality of longitudinally spaced fans for producing gas flow at longitudinally spaced intervals within said zone, selectively and independently, in either of two substantially opposed lateral directions, and a plurality of wheel-supported carts adapted to be received at such longitudinally spaced intervals within said zone, each of said carts having a pair of laterally spaced wheels and carrying a charge which is to be dried within said zone, rail means forming a longitudinally extending path into an out of said zone, said rail means including plural, longitudinally spaced pair of laterally spaced, independently vertically movable, disjoined rail sections, disposed in sets to be engaged by the laterally spaced wheels of such carts at such spaced intervals within said zone, weight-sensing means for each set operatively connected to the rail sections therein for sensing the lateral distribution of weight carried by said sections, and means operatively connecting each of said weight-sensing means and the associated fan to adjust the direction of gas flow produced by the latter according to the weight distribution sensed by said former, thus substantially to equalize the rate of drying of opposed lateral sides of such charge on the associated cart.

* * * * *